United States Patent [19]

Kampf

[11] 4,387,861

[45] Jun. 14, 1983

[54] MACHINE FOR SEPARATING DOUBLE-ROLLED ALUMINUM SHEET

[75] Inventor: Eberhard Kampf, Wiehl, Fed. Rep. of Germany

[73] Assignee: Erwin Kampf GmbH & Co., Wiehl, Fed. Rep. of Germany

[21] Appl. No.: 290,669

[22] Filed: Aug. 5, 1981

[51] Int. Cl.[3] ..... B65H 23/20; B65H 35/02

[52] U.S. Cl. ..... 242/75.47; 242/56.4; 242/67.3 R

[58] Field of Search ..... 242/75.47, 67.1 R, 67.3 R, 242/56.2, 75.45, 56.4, 56.5, 75.5, 75.51; 69/10; 318/6, 7

[56] References Cited

U.S. PATENT DOCUMENTS

| | | | |
|---|---|---|---|
| 1,058,962 | 4/1913 | Gay | 69/10 |
| 1,800,182 | 4/1931 | Kirk | 242/67.3 |
| 2,092,966 | 9/1937 | Gay | 242/56.4 X |
| 3,823,887 | 7/1974 | Gerstein | 242/56.2 |
| 4,322,043 | 3/1982 | Grollimund | 242/67.3 R |

*Primary Examiner*—Edward J. McCarthy
*Attorney, Agent, or Firm*—Joseph A. Geiger

[57] ABSTRACT

Machine for separating double-rolled thin aluminum sheet and for winding the separated sheets onto winding shafts, the coil-carrying supply shaft being driven by a motor-generator controlled by a speed control circuit for a constant sheet speed, following acceleration of the supply coil. The traction rolls and deflecting rolls in the processing section are driven by a traction motor controlled by a tension control circuit for a constant sheet tension independently of the sheet speed. The winding shafts for the separated sheets are similarly controlled by tension control circuits for a constant sheet tension independently of the sheet speed. The control circuits have preset members for the adjustment of nominal speed and tension settings.

3 Claims, 1 Drawing Figure

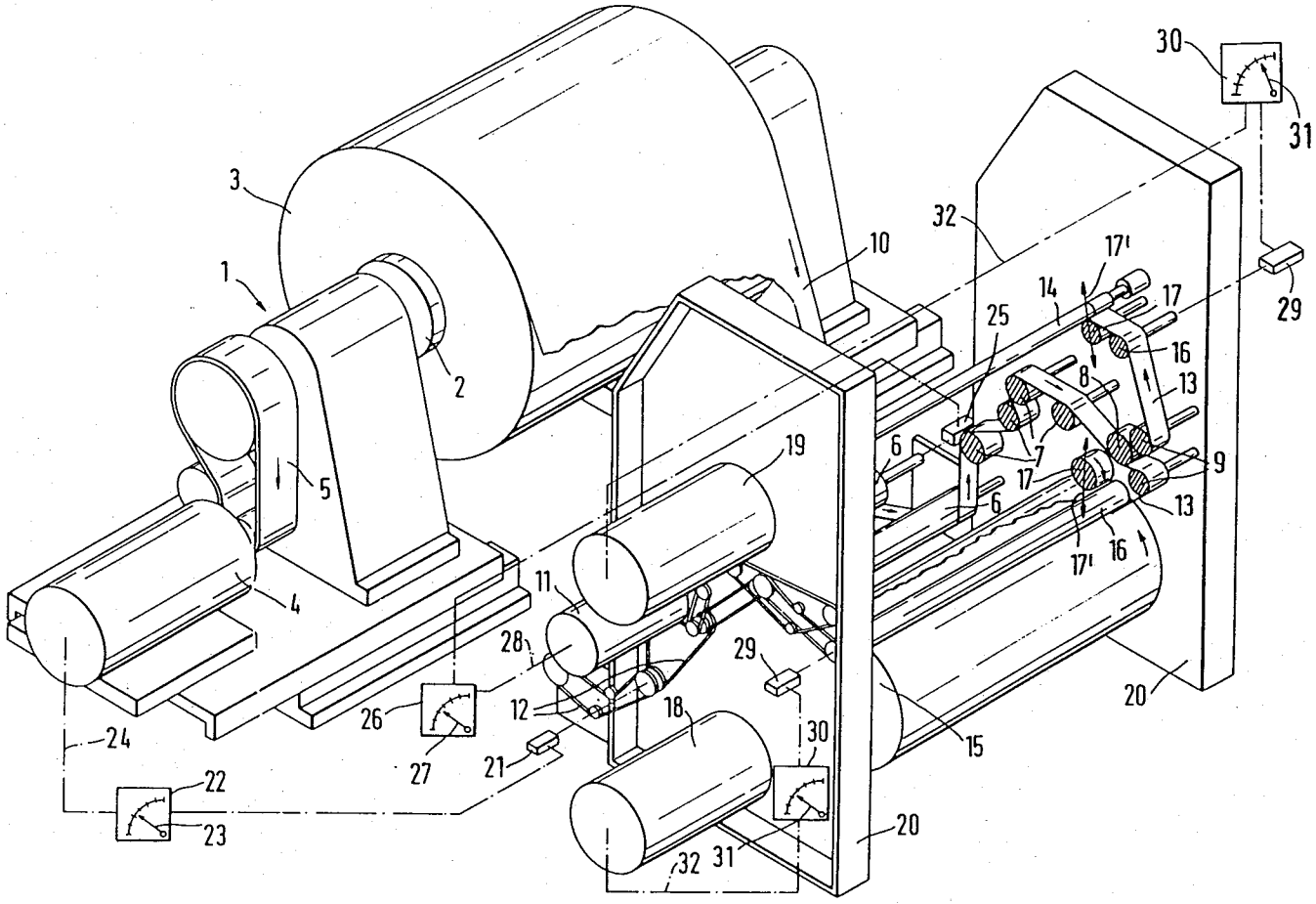
1
2
3
4
5
6
7
8
9
10
11
12
13
14
15
16
17
17'
18
19
20
21
22
23
24
25
26
27
28
29
30
31
32

MACHINE FOR SEPARATING DOUBLE-ROLLED ALUMINUM SHEET

BACKGROUND OF THE INVENTION

1. Field of the Invention

The present invention relates to sheet processing and rewinding devices, and, more particularly, to a machine for separating double-rolled thin aluminum sheet into two single-thickness sheets which are wound onto separate winding shafts, under controlled conditions, using motors of variable speed and torque to control the supply, advancement, and winding of the sheet at a controlled speed and sheet tension.

2. Description of the Prior Art

It has become common practice to produce thin aluminum sheet or aluminum foil in a double-rolled form which requires the subsequent separation of the double-sheet into two separate sheets, preferably in combination with the longitudinal slitting of the sheet into a plurality of sheet strips. In known sheet processing machines used for this purpose, the base parameter for the sheet drive is a constant sheet speed in the processing section of the machine, determined by a variable-speed motor which drives the traction rolls and deflecting rolls of the processing section. Included with the latter may be appropriate separating rolls and sheet slitting means. The sheet speed is monitored by means of a sheet speed measuring device, for example, a tachogenerator. It follows that the drive parameters for the supply shaft are predetermined by the preset sheet speed, taking also into account the decreasing diameter of the supply coil.

A known machine of the aforementioned type features means for measuring the sheet tension between the supply coil and the processing section of the machine, utilizing this measurement to control the torque of the motor-generator of the supply shaft drive to maintain a constant sheet tension. This kind of control system requires expensive drive components, considering the necessary high power output ratings, And, in spite of the use of very powerful drive components, such a machine tends to encounter problems of inaccurate control during the startup and acceleration phase of its operation, in view of the large mass which needs to be accelerated, when the supply shaft carries a full coil. The drive controls also must provide a continuous adjustment of the supply shaft drive to the decreasing supply coil diameter.

The aforementioned shortcomings of the known sheet processing machine represent basic difficulties which are inherent with this type of control system. The drive motors for the winding shafts have control means which maintain a constant sheet winding tension. No major problems are encountered with these winding devices.

SUMMARY OF THE INVENTION

It is a primary objective of the present invention to suggest an improved aluminum sheet separating machine of the above-mentioned type which allows for a more accurate and more reliable control of its operational parameters. More particularly, this improved machine is to utilize drive components of considerably reduced power requirements.

The present invention proposes to attain these objectives, by suggesting an aluminum sheet separating machine in which the sheet speed in the machine is determined by the motor-generator of the supply shaft drive with the aid of a speed control circuit, the machine having a separate tension control circuit for the motor driving the traction rolls and deflecting rolls, aimed only at maintaining a preset sheet tension or drive torque By arranging for the supply shaft drive to determine the sheet speed in the machine, the latter is much better equipped to accommodate the special startup and acceleration conditions which pertain to a full supply coil. Consequently, it is no longer necessary to utilize a greatly oversized motor-generator to achieve the fastest-possible acceleration to the predetermined nominal sheet speed. The invention makes it possible to increase the sheet speed slowly, while the sheet drive components of the processing section of the machine, being controlled for sheet tension only, adapt their speed to the speed at which the sheet is unwound from the supply coil. A constant level of sheet tension or unwinding traction is maintained in the processing section by supplying the drive shafts in this section with a constant torque from their drive motor. To the extent that acceleration in the processing section of the machine takes place during startup, the inertia and torque values involved are comparatively small, so that this motor need not be oversized.

The novel controls for the proposed aluminum sheet separating machine will thus maintain a constant sheet tension, both during the gradual acceleration phase of operation and during the normal processing operation. A sheet tension measuring device arranged in the processing section of the machine controls the torque of the drive motor for the traction rolls by means of a feedback control circuit. Alternatively, it is also possible to obtain a constant torque on the drive motor by directly controlling the armature current.

An additional advantage of the present invention resides in the fact that the feedback circuit which controls the motor-generator of the supply shaft drive, by using a constant sheet speed as its only control parameter, not only accommodates a gradual acceleration at startup, but also automatically compensates for the progressive decrease in the coil diameter during operation.

BRIEF DESCRIPTION OF THE DRAWING

Further special features and advantages of the invention will become apparent from the description following below, when taken together with the accompanying drawing which illustrates, by way of example, an embodiment of the invention which is represented as follows:

The sole FIGURE shows, in a somewhat schematic perspective representation, the major components of an aluminum sheet separating machine in accordance with the present invention.

DESCRIPTION OF THE PREFERRED EMBODIMENT

As can be seen in the drawing, the aluminum sheet separating machine of the invention comprises a supply device 1 with a supply shaft 2 carrying a supply roll or coil 3 of double-rolled thin aluminum sheet. The drive for the supply shaft 2 consists of a motor-generator 4 and a suitable drive transmission 5. The motor-generator 4 provides drive power during the startup and acceleration phase of the operation and regenerative braking power during the normal unwinding operation.

In alignment with the supply device 1 is arranged the actual processing section of the machine, where the sheet which is unwound from the supply coil 3 is taken up by traction rolls 6, deflecting rolls 7, a separating roll 8, and additional deflecting rolls 9 which guide the individual sheets 13 away from the separating roll 8. Appropriate slitting devices may be arranged at a slitting station in this processing section.

For the sake of greater clarity of the drawing, the doubled sheet 10 is shown reduced to a narrow strip, in order to show its path through the processing section, and the various processing rolls are likewise cut away at the width of the sheet strip. Thus, it should be understood that the doubled sheet 10 and the individual sheets 13, as well as the various processing rolls and shafts extend over the full width of the machine. A variable-speed motor 11 drives the rolls of the processing section which are interconnected by means of suitable drive belts or drive chains 12.

Following the separation of the doubled sheet 10 by the separating roll 8 and the two cooperating deflecting rolls 9 into upper and lower individual sheets 13, the latter are guided towards two winding shafts 14 and 15. Each winding shaft has a winding station which includes a deflecting roll 16 and a pressure roll 17, the latter being displaceble along the double-arrow 17', in accordance with the radius of the coil on the winding shafts 14 and 15. Directly connected to each winding shaft is a variable-speed winding motor, the motor 18 driving the winding shaft 15 and the motor 19 driving the winding shaft 14. The various rolls of the processing section of the machine and the two winding shafts, including their drive motors and drive transmissions, are supported by two side frames 20.

To one of the rolls of the processing section of the machine is connected to sheet speed measuring device 21, such as a tacho-generator or some other suitable speed transducer, the device 21 producing an electrical signal which reflects the lineal sheet speed. This speed signal is introduced into a speed control circuit 22 which provides a feedback connection between the motor-generator 4 of the supply device 1 and the sheet speed measuring device 21 of the processing section. An adjustable preset member 23 in the speed control circuit 22 determines the desired nominal sheet speed.

As the actual sheet speed deviates from the nominal speed, the control circuit 22 produces a deviation signal reflecting the difference between the nominal speed setting and the speed signal received from the tacho-generator 21. This deviation signal, appropriately amplified, becomes a control signal for the motor-generator 4 which is linked to the speed control circuit 22 over a line 24. In response to this control signal, the speed of the motor-generator 4 is correspondingly increased or decreased, until the actual sheet speed matches the nominal sheet speed setting at 23. This feedback circuit controls the supply shaft drive in such a way that the sheet 10 is unwound from the supply coil 3 at a constant lineal speed, adjusted at the preset member 23, independently of the decreasing diameter of coil 3.

The processing section of the machine further includes a sheet tension measuring device 25 which is connected to the traction roll 6, for example. This is a transducer device which produces an electric signal reflecting the sheet tension, supplying the signal to a tension control circuit 26 which is connected to the motor 11 over line 28. The desired nominal sheet tension can be adjusted in the tension control circuit 26 by means of a preset member 27.

As in the case of the speed control circuit 22, the tension control circuit 26 establishes a deviation signal between the measured sheet tension and the nominal sheet tension, set at 27, from which is derived a control signal for the torque of the motor 11. It is, of course, also possible to directly preset the torque value for the motor 11 and to control the latter by maintaining a constant armature current for the motor 11. Essentially, any suitable sheet tension control means will satisfy the requirements of this invention.

The invention further suggests the arrangements of two separate sheet tension measuring devices 29 in conjunction with the deflecting rolls 16 of the upper and lower sheet winding stations. Each tension measuring device 29 is part of a tension control circuit 30 which has a tension preset member 31 for the adjustment of a nominal winding tension. The control signal produced by the tension control circuit 30 is supplied to the winding motor 18 over the line 32. A corresponding tension control circuit is provided for the upper winding motor 19.

The aluminum sheet separating machine of the invention thus features adjustably controllable drive motors of comparatively low power rating. By allowing for a slower acceleration of the supply coil 3, the drive for the supply shaft 2 can have a much smaller motor-generator 4, its motor capacity being determined entirely by the acceleration which is applied to the supply coil 3 during startup of the machine. The motor 11 which drives the rolls of the processing section requires no power reserve, because its only requirement is to maintain a constant sheet tension. Being controlled for torque only, this motor therefore maintains the desired sheet tension during both the acceleration phase and the regular rewinding phase of the machine operation.

By thus maintaining a constant sheet tension in the processing section, independently of the sheet speed, and by also providing separate sheet tension controls for both winding drives, likewise independently of the sheet speed, the invention achieves a high degree of control accuracy and control stability, while allowing for a slower startup of the machine, thereby greatly reducing its energy consumption and its manufacturing cost.

It should be understood, of course, that the foregoing disclosure describes only a preferred embodiment of the invention and that it is intended to cover all changes and modifications of this example of the invention which fall within the scope of the appended claims.

I claim the following:

1. A machine for separating double-rolled thin aluminum sheet into two separate sheets and for winding the sheets onto two winding shafts, the machine comprising in combination:

a supply shaft adapted to carry a supply coil of double-sheet;

a supply shaft drive, including a motor-generator operating as a motor for the acceleration of the supply coil from standstill to operating speed and as a regenerative braking generator for the application of a braking torque to the supply shaft following acceleration;

a sheet processing section arranged in parallel alignment with the supply shaft to receive the double-sheet from the supply coil, said section including a sheet separating roll, a plurality of sheet deflecting rolls and a winding shaft for each of the two separate sheets with a variable-speed winding motor connected thereto;

circuit means for controlling the torque output of the motor-generator in such a way that the speed at which the double-sheet is unwound from the supply coil is maintained substantially constant, following acceleration of the supply coil; and circuit means for controlling the torque output of the two winding motors in such a way that the tension at which the separate sheets are wound onto their winding shafts is maintained substantially constant, independently of the sheet speed.

2. A sheet separating machine as defined in claim 1, wherein at least one of the rolls in the sheet processing section serves as a traction roll on the double-sheet and has connected to it a variable-speed traction motor; and the machine further comprises circuit means for controlling the torque output of the traction motor in such a way that the tension at which the double sheet is advanced towards the separating roll is maintained substantially constant, independently of the sheet speed.

3. A sheet separating machine as defined in claim 1 or claim 2, wherein the circuit means controlling the motor-generator for constant speed is a feedback-type speed control circuit which includes a speed transducer producing an electrical signal indicative of the sheet speed, an adjustable speed preset member, and means for interpreting the difference between the actual sheet speed and a preset sheet speed and for adjusting the field conditions of the motor-generator in the sense of eliminating said difference.

* * * * *